US008591007B2

(12) United States Patent
Goto

(10) Patent No.: US 8,591,007 B2
(45) Date of Patent: Nov. 26, 2013

(54) INK JET RECORDING HEAD AND METHOD OF PRODUCING THE SAME

(75) Inventor: Akio Goto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 61 days.

(21) Appl. No.: 13/358,008

(22) Filed: Jan. 25, 2012

(65) Prior Publication Data

US 2012/0194618 A1 Aug. 2, 2012

(30) Foreign Application Priority Data

Feb. 2, 2011 (JP) ..... 2011-020785

(51) Int. Cl.
*B41J 2/05* (2006.01)

(52) U.S. Cl.
USPC ..... 347/61

(58) Field of Classification Search
USPC ..... 347/20, 40, 56, 60, 48, 54, 61, 62
See application file for complete search history.

(56) References Cited

U.S. PATENT DOCUMENTS 4,947,189 A * 8/1990 Braun et al. ..... 347/62
5,200,641 A 4/1993 Kosaki

FOREIGN PATENT DOCUMENTS

JP 4-144157 A 5/1992

* cited by examiner

*Primary Examiner* — Matthew Luu
*Assistant Examiner* — Renee I Wilson
(74) *Attorney, Agent, or Firm* — Fitzpatrick, Cella, Harper & Scinto

(57) ABSTRACT

Provided is an ink jet recording head, including: an ink ejection portion, in which heat is applied to ink supplied inside thereof, thereby providing the ink with a pressure for ejecting the ink outside; a substrate having a first surface on which the ink ejection portion is provided and a second surface on an opposite side to the first surface, the second surface having at least one recess; and a heat radiation member for releasing heat outside, the heat being transmitted from the ink ejection portion to the substrate, the heat radiation member having a protrusion with a shape corresponding to a shape of the recess, the protrusion being embedded in the recess so that the protrusion is provided in direct contact with the recess.

8 Claims, 5 Drawing Sheets

INK JET RECORDING HEAD AND METHOD OF PRODUCING THE SAME

BACKGROUND OF THE INVENTION

1. Field of the Invention

The present invention relates to an ink jet recording head for ejecting ink through use of heat energy, and a method of producing the ink jet recording head.

2. Description of the Related Art

Hitherto, an ink jet recording apparatus for ejecting ink to record an image on a recording medium is known. An ink jet recording head for ejecting ink is mounted on the ink jet recording apparatus.

There is an ink jet recording head that includes an ink ejection portion for ejecting an ink droplet through use of heat energy on a substrate. The ink ejection portion includes a heating resistor element for applying heat to supplied ink to provide the ink with an ejection pressure, and a nozzle plate provided with a nozzle for ejecting the ink. A groove is formed in one side surface of the nozzle plate, and the nozzle plate is provided on the substrate so that the one side surface is held in abutment with the substrate. The groove and the substrate form an ink flow path.

The heating resistor element is placed at a position on the substrate where the heating resistor element is capable of applying heat to ink stored in the ink flow path. When the heating resistor element generates heat at a desired timing, the ink stored in the ink flow path is heated. The heated ink is boiled to generate a bubbling pressure, which allows the ink in the ink flow path to be ejected from the nozzle communicating with the ink flow path.

In such an ink jet recording head, the heat generated by the heating resistor element may be transmitted also to the substrate, and the temperature of the substrate may rise.

When the temperature of the substrate rises, the ink in the ink flow path is heated by the heat of the substrate. That is, the ink is heated even in a state in which the heating resistor element does not generate heat, and the ink is boiled more easily. Thus, when the heating resistor element generates heat, the heated ink is ejected in a period of time shorter than that of ink not heated by the substrate. As a result, the ink is ejected at a timing different from a desired timing, which causes a degradation in quality of a recorded image.

Further, the heat of the substrate may be transmitted to the nozzle plate, to thereby change the shape of the nozzle. The deformation of the nozzle may change the size of the ink droplet and an ejection direction thereof, and the ink droplet landing point deviates from a desired position to cause a degradation in quality of a recorded image.

Accordingly, Japanese Patent Application Laid-Open No. H04-144157 discloses a structure in which a heat radiation member for releasing heat of a substrate is provided on the substrate. By releasing the heat of the substrate through the heat radiation member, an increase in temperature of the substrate can be suppressed, and hence the heating of ink by the substrate and the deformation of the nozzle can be suppressed. As a result, the degradation in quality of a recorded image can be suppressed.

However, in recent years, there has been a demand for an ink jet recording head capable of recording an image with higher quality at a higher speed.

In order to enhance image quality, an increase in density of the nozzle is effective, and along with this, it has been proposed that the heating resistor elements be placed on the substrate at a higher density. Therefore, in such an ink jet recording head, a greater amount of heat can be transmitted to the substrate more easily.

Further, in order to record an image at a higher speed, it has been proposed that the interval between timings for the heating resistor elements to generate heat be shortened. In this case, the amount of the heat generated by the heating resistor elements per unit time becomes larger.

By increasing the density of the arrangement of the heating resistor elements and shortening the interval between the timings for the heating resistor elements to generate heat, in the structure disclosed by Japanese Patent Application Laid-Open No. H04-144157, the amount of the heat transmitted from the heating resistor elements to the substrate may become larger than that transmitted from the substrate to the heat radiation member in some cases. As a result, the heat of the substrate may not be released sufficiently, and the temperature of the substrate may rise, to thereby degrade recording quality.

SUMMARY OF THE INVENTION

It is an object of the present invention to provide an ink jet recording head having a higher heat radiation property, and a method of producing the ink jet recording head.

In order to achieve the above-mentioned object, an ink jet recording head according to an aspect of the present invention includes: an ink ejection portion, in which heat is applied to ink supplied inside thereof, thereby providing the ink with a pressure for ejecting the ink outside; a substrate having a first surface on which the ink ejection portion is provided and a second surface on an opposite side to the first surface, the second surface having at least one recess; and a heat radiation member for releasing heat outside, the heat being transmitted from the ink ejection portion to the substrate, the heat radiation member having a protrusion with a shape corresponding to a shape of the at least one recess, the protrusion being embedded in the at least one recess so that the protrusion is provided in direct contact with the at least one recess.

Further, another aspect of the present invention relates to a method of producing an ink jet recording head including: an ink ejection portion, in which heat is applied to ink supplied inside thereof, thereby providing the ink with a pressure for ejecting the ink outside; a substrate having a first surface on which the ink ejection portion is provided and a second surface on an opposite side to the first surface, the second surface having at least one recess; and a heat radiation member for releasing heat outside, the heat being transmitted from the ink ejection portion to the substrate, the heat radiation member having a protrusion with a shape corresponding to a shape of the at least one recess, the protrusion being embedded in the at least one recess so that the protrusion is provided in direct contact with the at least one recess. In this aspect, the method includes: the step of forming the at least one recess in the second surface of the substrate; and the step of forming the heat radiation member so that the heat radiation member covers the second surface under a state in which a material for the heat radiation member fills the at least one recess.

Further features of the present invention will become apparent from the following description of exemplary embodiments with reference to the attached drawings.

DESCRIPTION OF THE EMBODIMENTS

Hereinafter, an ink jet recording head and a method of producing the ink jet recording head according to the present invention are described in detail with reference to the drawings.

First Embodiment

Figure 1A:
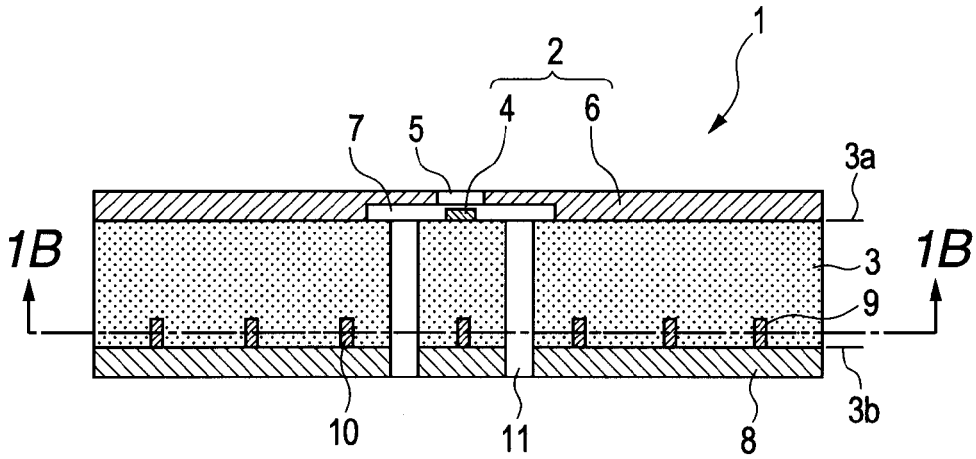
FIGS. 1A and 1B are cross-sectional views of an ink jet recording head according to a first embodiment of the present invention.
Figure 1B:
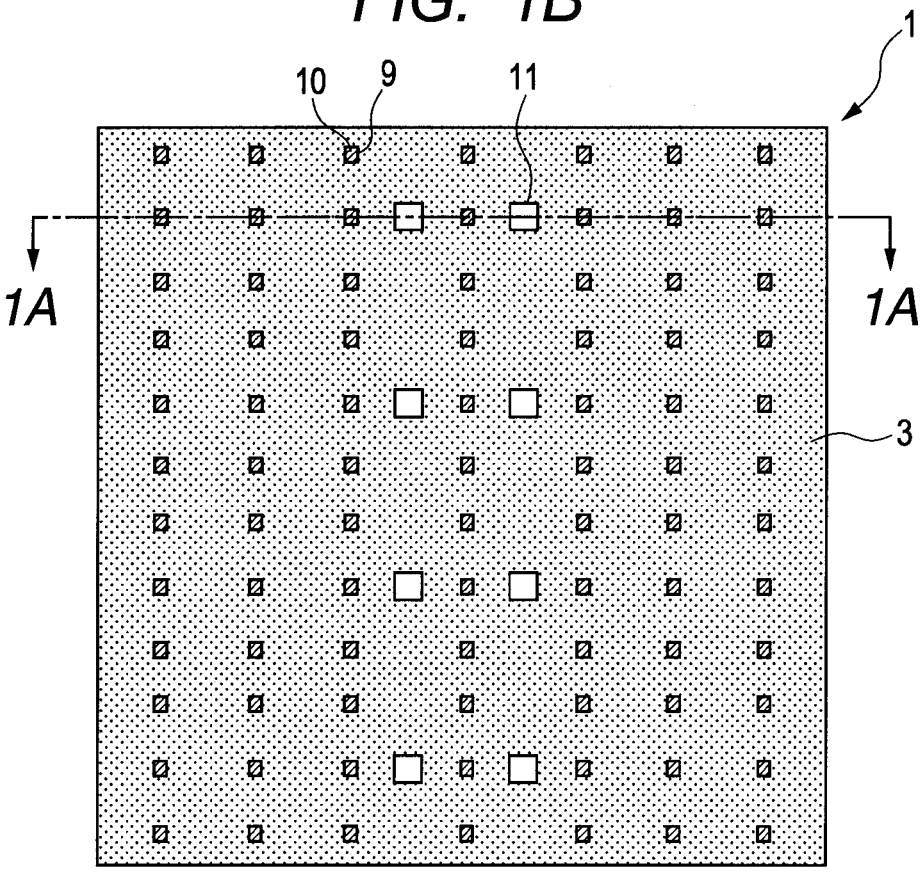

FIGS. 1A and 1B are cross-sectional views of an ink jet recording head according to a first embodiment of the present invention. As illustrated in FIG. 1A, an ink jet recording head 1 includes an ink ejection portion 2 in which heat is applied to ink supplied therein, thereby providing the ink with a pressure for ejecting the ink outside, and a substrate 3 having a first surface 3*a* on which the ink ejection portion 2 is provided.

FIG. 1A is a cross-sectional view taken along line 1A-1A in FIG. 1B perpendicularly crossing the first surface 3*a* of the substrate 3. Further, FIG. 1B is a cross-sectional view taken along line 1B-1B in FIG. 1A parallel to the first surface 3*a* of the substrate 3.

The ink ejection portion 2 includes a heating resistor element 4 for applying heat to ink to provide the ink with an ejection pressure, and a nozzle plate 6 provided with a nozzle 5 for ejecting the ink. The nozzle plate 6 is provided on the first surface 3*a* of the substrate 3. A surface of the nozzle plate 6 on the substrate 3 side is provided with a groove, and the first surface 3*a* of the substrate 3 and the groove form an ink flow path 7.

The heating resistor element 4 is provided on the substrate 3 so as to be placed in the ink flow path 7 or in the vicinity thereof. The heating resistor element 4 generates heat energy to heat ink in the ink flow path 7. The heated ink is boiled and a bubbling pressure is generated in the ink. The bubbling pressure functions as an ejection force of the ink. The ink flow path 7 and the nozzle 5 communicate with each other, and the ink provided with the ejection force from the heating resistor element 4 in the ink flow path 7 is ejected through the nozzle 5.

Further, in the ink jet recording head 1, a heat radiation member 8 made of a material that has a heat conductivity higher than that of the substrate 3 and releases heat easily is provided on a second surface 3*b* of the substrate 3. When the heating resistor element 4 generates heat, the heat is transmitted not only to the ink in the ink flow path 7 but also to the substrate 3. The heat transmitted to the substrate 3 is transmitted to the heat radiation member 8, and is radiated outside of the ink jet recording head 1 (for example, atmosphere around the ink jet recording head 1 or a component (not shown) provided in abutment with the heat radiation member 8) from the heat radiation member 8.

The heat conductivity of the heat radiation member 8 is higher than that of the substrate 3, and hence heat is released more easily to the outside of the ink jet recording head 1 from the substrate 3, compared with an ink jet recording head having no heat radiation member 8. More specifically, the heat radiation member 8 can further suppress an increase in temperature of the substrate 3 by the heating resistor element 4 and prevent an increase in temperature of the ink by the substrate 3.

Further, by providing the heat radiation member 8 on the second surface 3*b*, the heat generated from the heating resistor element 4 can move more easily toward the second surface 3*b*. Thus, the movement of heat from the substrate 3 to the nozzle plate 6 provided on the first surface 3*a* is suppressed, which can prevent the nozzle 5 from being deformed by an increase in temperature of the nozzle plate 6.

Further, in a region, in which the heat radiation member 8 is provided, in the second surface 3*b* of the substrate 3, at least one recess 9 is formed. Further, the heat radiation member 8 has a protrusion 10 having a shape corresponding to the shape of the recess 9, and the heat radiation member 8 is joined to the second surface 3*b* under a state in which the protrusion 10 is embedded in the recess 9. The protrusion is embedded in the recess so as to be in direct contact with the recess. Direct contact means that the protrusion and the recess are brought into contact with each other with no adhesive or the like interposed therebetween. Such a configuration can enhance a heat radiation property of the ink jet recording head 1. Further, the performance as a mask described later is also enhanced.

Thus, the contact area of the substrate 3 and the heat radiation member 8 is larger than that in a case where the substrate 3 and the heat radiation member 8 are provided in contact with each other at planes without unevenness, and heat is transmitted more easily from the substrate 3 to the heat radiation member 8. That is, the increase in temperature of the substrate 3 and the nozzle plate 6 can be further suppressed, and hence the increase in temperature of the ink by the substrate 3 and deformation of the nozzle 5 due to the increase in temperature of the nozzle plate 6 can be further prevented.

Note that, in this embodiment, the recess 9 has a hole shape, and the protrusion 10 has a columnar shape matched with the hole shape. Needless to say, the recess 9 and the protrusion 10 may have other shapes. For example, the recess 9 may have a groove shape, and the protrusion 10 may have a protrusion shape matched with the groove shape.

Further, ink supply paths 11 for supplying ink from outside of the ink jet recording head 1 (for example, an ink tank (not shown)) to the ink flow path 7 may be provided in the ink jet recording head 1 in such a manner as to pass through the substrate 3 and the heat radiation member 8. Openings of the ink supply paths 11 formed in the second surface 3*b* and the ink tank (not shown) are connected to each other, to thereby supply ink from the ink tank to the ink flow path 7.

By using through-holes passing through the substrate 3 and the heat radiation member 8 as the ink supply paths 11, the ink jet recording head 1 having the ink supply paths 11 can be produced more easily with a smaller number of components.

Next, a method of producing the ink jet recording head 1 illustrated in FIGS. 1A and 1B is described with reference to FIGS. 2A to 2F. FIGS. 2A to 2F are cross-sectional views illustrating the method of producing the ink jet recording head 1.

Here, a production method is described in which a single crystal silicon wafer is used for the substrate 3, and the single crystal silicon wafer is processed by dry etching using a mixed gas containing sulfur hexafluoride and oxygen to form the substrate 3. Note that, depending upon the shape of the substrate 3, the single crystal silicon wafer may be processed by dry etching using reactive ions, isotropic wet etching, or anisotropic wet etching.

Figure 2A:
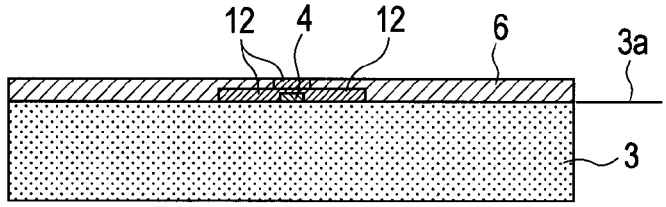
FIGS. 2A, 2B 2C, 2D, 2E and 2F are cross-sectional views illustrating a method of producing the ink jet recording head according to the first embodiment of the present invention.

First, as illustrated in FIG. 2A, the substrate 3 is prepared, which includes the heating resistor element 4, a mold 12 that is formed in regions to be the ink flow path 7 and the nozzle 5 (FIG. 1A), and the nozzle plate 6 on the first surface 3*a*.

The heating resistor element 4, the mold 12, and the nozzle plate 6 can be formed by a film formation method such as chemical vapor deposition (CVD) using plasma and sputtering vapor deposition. Further, etching using a photoresist mask can be applied for forming the heating resistor element 4.

When the heating resistor element 4 and the mold 12 are formed, an etching stop layer (not shown) having an etching resistance property and a conductor (not shown) that transmits an electric signal to the heating resistor element 4 may be formed on the first surface 3*a* of the substrate 3.

It is desired that the etching stop layer be removed sufficiently slowly with respect to the substrate 3 when the substrate 3 is processed by dry etching. Examples of a material for such an etching stop layer include aluminum and a silicon oxide. A removal agent of the etching stop layer is desirably removed faster with respect to the substrate 3, and examples thereof include hydrofluoric acid and a phosphoric acid and nitric acid mixture.

For patterning the etching stop layer and the conductor, etching using a photoresist mask can be applied.

Figure 2B:
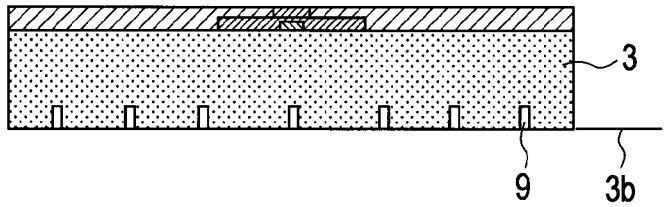

Next, the process proceeds to a recess formation step of forming the recesses 9 in the second surface 3*b* of the substrate 3 (FIG. 2B). The recesses 9 are formed by forming, on the second surface 3*b*, a resist pattern (not shown) having openings, and etching the second surface 3*b*. The openings of the resist pattern are provided at positions where the recesses 9 are formed, and portions of the single crystal silicon wafer at the openings are removed by etching to form the recesses 9. After the recesses 9 are formed, the resist pattern is peeled from the substrate 3.

Figure 2C:
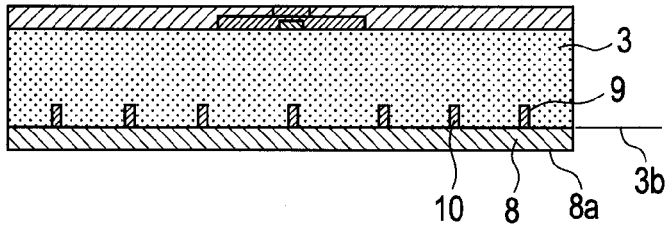

Subsequently, the process proceeds to a heat radiation member formation step of forming the heat radiation member 8 on the second surface 3*b* of the substrate 3 (FIG. 2C). At this time, the heat radiation member 8 is formed so as to cover the second surface 3*b* under a state in which the heat radiation member 8 fills the recesses 9. By forming the heat radiation member 8 in this manner, the heat radiation member 8 having the protrusions 10 with a shape corresponding to the shape of the recesses 9 can be obtained relatively easily.

A surface 8*a* of the heat radiation member 8 on an opposite side to the substrate 3 may have an uneven shape due to the shape of the second surface 3*b* of the substrate 3, that is, due to the recesses 9. It is more preferred that the surface 8*a* of the heat radiation member 8 be polished so as to be planarized.

As the material for the heat radiation member 8, a metal such as Au, Ta, Pt, or Ir having a heat conductivity higher than that of the single crystal silicon and having a relatively high ink resistance property, or alloys composed of at least two of these metals are desired. Further, when a metal such as Au is used, the heat radiation member 8 may be formed by electroplated coating so that the metal sufficiently fills the inside of each of the recesses 9. The plating thickness may be about 40 μm to 70 μm.

When the heat radiation member 8 is formed, using the electroplated coating, a plating seed layer (not shown) may be formed on the second surface 3*b* including inner surfaces of the recesses 9 so that the heat radiation member 8 is adhered to the substrate 3 relatively strongly.

As the plating seed layer, Ti/Au, TiW, Ti/Pd, or the like can be used. In a case of Ti/Au, it is desired that the film thickness be 2,000 Å for Ti and 4,000 Å for Au. Needless to say, the film thickness is not limited thereto.

Examples of a formation method for the plating seed layer include vapor deposition. When the vapor deposition is used, the angle of the second surface 3*b* with respect to a deposition direction can be changed so as to form the plating seed layer on bottom surfaces and side surfaces of the recesses 9.

Figure 2D:
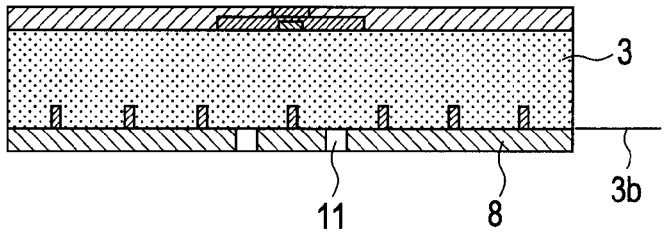
Figure 2E:
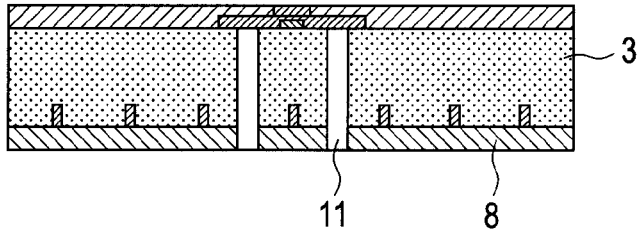

FIGS. 2D and 2E are cross-sectional views illustrating steps of forming the ink supply paths 11 illustrated in FIGS. 1A and 1B. As illustrated in FIG. 2D, the heat radiation member 8 in regions to be the ink supply paths 11 is removed to form a part of the ink supply paths 11 and to expose the second surface 3*b* at positions where the ink supply paths 11 are to be formed. When Au is used for the heat radiation member 8, Au can be removed by etching using an iodine-potassium iodide solution so as to form a part of the ink supply paths 11 in the heat radiation member 8.

When the plating seed layer (not shown) is formed on the second surface 3*b* of the substrate 3, the plating seed layer in the regions corresponding to the ink supply paths 11 is removed. When Ti/Au is used for the plating seed layer, the plating seed layer may be removed by etching using hydrogen peroxide.

Next, as illustrated in FIG. 2E, the substrate 3 in the regions to be the ink supply paths 11 is removed to form the ink supply paths 11. The ink supply paths 11 can be formed by dry etching using CF-based reactive ions.

A metal such as Au is removed sufficiently slowly in dry etching compared with the single crystal silicon wafer. Thus, when the heat radiation member 8 is formed of a metal such as Au, the substrate 3 can be processed by dry etching, using a remaining part of the heat radiation member 8 as an etching mask. By using the heat radiation member 8 as the etching mask, a step of separately forming the etching mask for dry etching can be omitted.

Figure 2F:
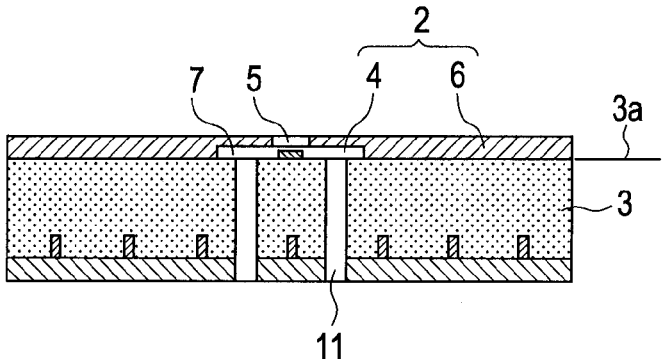

Subsequently, as illustrated in FIG. 2F, the mold (FIG. 2A) is removed to form the ink flow path 7 and the nozzle 5.

When the etching stop layer (not shown) is formed on the first surface 3*a* of the substrate 3 in the step of forming the heating resistor element 4 and the mold 12 (FIG. 2A), the etching stop layer is removed before removing the mold 12. When aluminum or a silicon oxide is used for the etching stop layer, the etching stop layer can be removed from the ink supply path 11 side by etching using hydrofluoric acid or a phosphoric acid and nitric acid mixture.

By providing the etching stop layer on the first surface 3*a* of the substrate 3, the nozzle plate 6 can be prevented from being processed by dry etching when the ink supply paths 11 are formed. That is, the ink flow path 7 and the nozzle 5 can be formed with relatively high dimension accuracy.

The ink jet recording head 1 is completed by being separated from the single crystal silicon wafer with a dicer, if required.

The ink jet recording head 1 having the heating resistor elements 4 placed at a higher density compared with that of a conventional example was produced, using the above-mentioned production method, and a test was conducted in which recording was performed at a higher speed with respect to a recording medium. As a result, recording was performed with higher image quality. This is because the heat radiation property of the ink jet recording head 1 during recording is enhanced.

The ink jet recording head 1 used in the test was produced as follows.

An etching stop layer (not shown) was formed on the first surface 3*a* of the substrate 3 using aluminum, and a phosphoric acid and nitric acid mixture was used for etching of the etching stop layer. The substrate 3 was etched by dry etching using a mixed gas containing sulfur hexafluoride and oxygen. Further, TiW was vapor-deposited on the second surface 3*b* including the inner surfaces of the recesses 9 to form the plating seed layer (not shown).

In order to form the heat radiation member 8, a metal layer with a thickness of 40 μm made of Au was formed on the second surface 3*b* by electroplated coating, and the surface of the metal layer was polished so as to be planarized, to thereby form the heat radiation member 8. Through the planarization, the thickness of the heat radiation member 8 from the second surface 3*b* was set to be 5 μm.

In order to form the ink supply paths 11, portions of the heat radiation member 8 were removed by etching using an iodine-potassium iodide solution, and the plating seed layer was removed by etching using hydrogen peroxide.

Second Embodiment

Figure 3A:
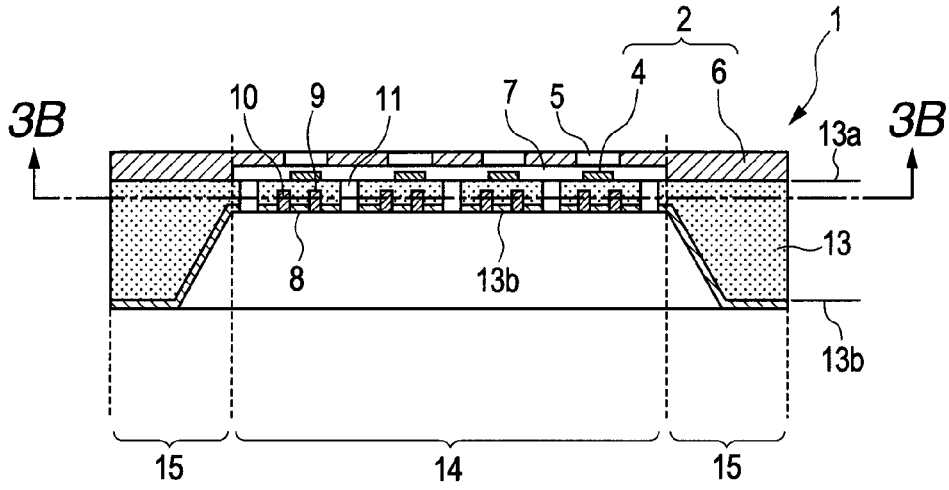
FIGS. 3A and 3B are cross-sectional views of an ink jet recording head according to a second embodiment of the present invention.
Figure 3B:
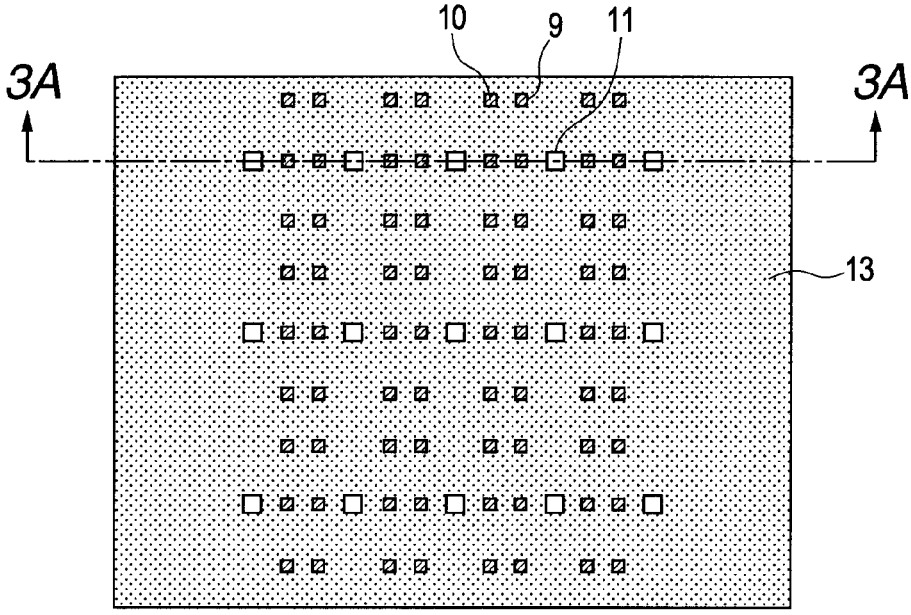

Next, an ink jet recording head according to a second embodiment of the present invention is described with reference to FIGS. 3A and 3B. FIGS. 3A and 3B are cross-sectional views of the ink jet recording head according to the second embodiment. Description of the same components as those of the first embodiment is omitted.

As illustrated in FIG. 3A, the ink jet recording head 1 of this embodiment includes a substrate 13 whose dimension in a path direction of the ink supply paths 11 (hereinafter, referred to as thickness) varies in one ink jet recording head 1. Specifically, a region of the substrate 13 in the vicinity where the ink supply paths 11 are formed (referred to as supply path formation region 14) is thinner than a region of the substrate 13 other than the supply path formation region 14, that is, a region where the ink supply paths 11 are not formed (referred to as supply path non-formation region 15).

Further, the ink jet recording head 1 according to this embodiment includes the ink ejection portion 2 and the heat radiation member 8 provided on the substrate 13 as in the first embodiment, and the ink supply paths 11 are formed so as to pass through the heat radiation member 8 and the substrate 13.

FIG. 3A is a cross-sectional view taken along line 3A-3A in FIG. 3B perpendicularly crossing a first surface 13*a* of the substrate 13 on which the ink ejection portion 2 is provided. Further, FIG. 3B is a cross-sectional view taken along line 3B-3B in FIG. 3A parallel to the first surface 13*a* of the substrate 13.

By setting the thickness of the supply path formation region 14 of the substrate 13 to be smaller, the path of each of the ink supply paths 11 can be shortened. Thus, the fluid resistance in each of the ink supply paths 11 can be decreased.

Further, by setting the thickness of the supply path non-formation region 15 of the substrate 13 to be larger, the strength of the ink jet recording head 1 can be increased. That is, a decrease in strength of the ink jet recording head 1 caused by the reduced thickness of the supply path formation region 14 can be suppressed.

By setting the thickness of the supply path formation region 14 to be smaller, the heat capacity of the supply path formation region 14 becomes smaller. Therefore, the temperature of the supply path formation region 14 rises easily due to the heat from the ink ejection portion 2.

In view of this, in this embodiment, at least one recess 9 is formed in a second surface 13*b* in the supply path formation region 14, and the radiation member 8 is joined to the second surface 13*b* with the protrusion 10 of the radiation member 8 embedded in the recess 9.

Thus, the contact area of the supply path formation region 14 and the heat radiation member 8 is larger than that in a case where the supply path formation region 14 and the heat radiation member 8 are provided in contact with each other at planes without unevenness, and heat is transmitted more easily from the supply path formation region 14 to the heat radiation member 8. As a result, the increase in temperature of the supply path formation region 14 due to the heat from the ink ejection portion 2 is suppressed. Hence, an increase in temperature of ink by the substrate 13 and deformation of the nozzle 5 due to an increase in temperature of the nozzle plate 6 can be prevented, and thus, an image with higher quality can be recorded at a higher speed.

Further, in this embodiment, the path of each of the ink supply paths 11 is shorter than that of the first embodiment and the fluid resistance thereof is smaller than that of the first embodiment. Therefore, ink can be supplied to the ink ejection portion 2 more rapidly. Thus, recording can be performed at a higher speed.

The ink jet recording head 1 was produced with the thickness of the substrate 13 in the supply path formation region 14 being 100 μm and the thickness of the substrate 13 in the supply path non-formation region 15 being 725 μm, and an image was recorded on a recording medium. As a result, the image was recorded at a speed higher than that of a conventional example without allowing the quality of the recorded image to be degraded.

Next, an example of a method of producing the ink jet recording head 1 according to this embodiment is described with reference to FIGS. 4A to 4F. FIGS. 4A to 4F are cross-sectional views illustrating the method of producing the ink jet recording head 1.

Figure 4A:
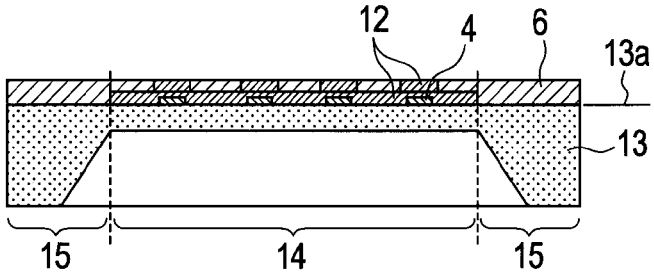
FIGS. 4A, 4B, 4C, 4D, 4E and 4F are cross-sectional views illustrating a method of producing the ink jet recording head according to the second embodiment of the present invention.

First, as illustrated in FIG. 4A, the substrate 13 is prepared, in which the heating resistor elements 4, the mold 12, and the nozzle plate 6 are laminated on the first surface 13*a*. When a single crystal silicon wafer is used for the substrate 13, the substrate 13 is obtained by partially removing, by etching, a region of the single crystal silicon wafer in a substantially rectangular shape, in the vicinity where the ink supply paths 11 (FIG. 3A) are to be formed. Note that, any one of the formation of the substrate 13 and the lamination of the heating resistor elements 4 and the like may be performed prior to the other.

Figure 4B:
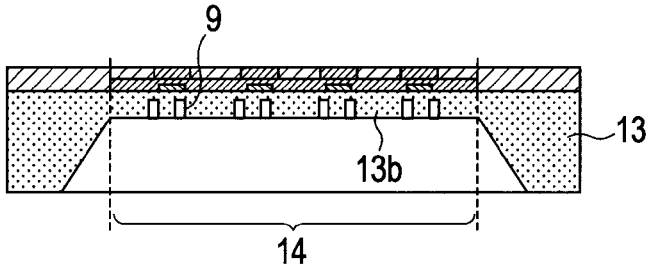
Figure 4C:
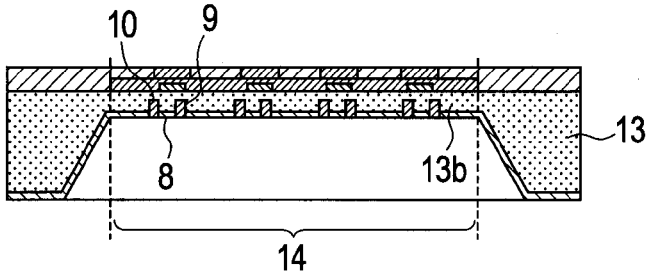

Subsequently, as illustrated in FIG. 4B, the recesses 9 are formed in the second surface 13*b* in the supply path formation region 14, and as illustrated in FIG. 4C, the second surface 13*b* is covered with a material for the heat-radiation member 8 under a state in which the material for the heat radiation member 8 fills the recesses 9. By forming the heat radiation member 8 in this manner, the heat radiation member 8 having the protrusions 10 with a shape corresponding to the shape of the recesses 9 can be obtained relatively easily.

Figure 4D:
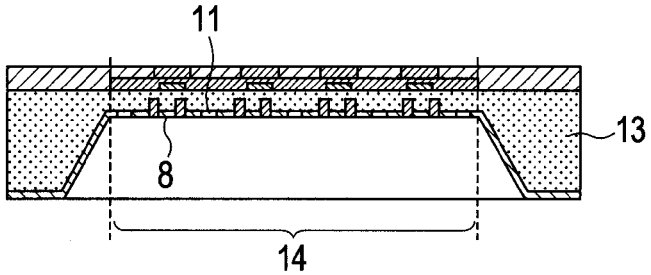
Figure 4E:
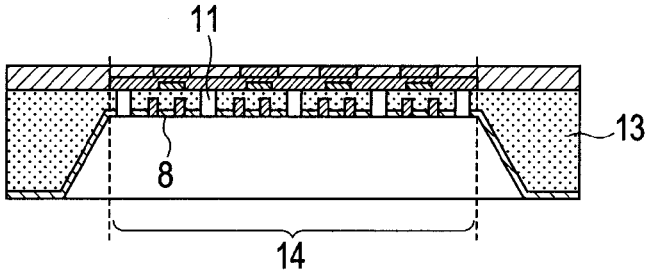

Next, as illustrated in FIGS. 4D and 4E, the ink supply paths 11 are formed. First, the heat radiation member 8 and the substrate 13 in the region where the ink supply paths 11 are to be formed are removed to form the ink supply paths 11.

Depending upon the shape of the ink supply paths 11, the fluid resistance which ink receives when flowing through the ink supply paths 11 may have a larger effect. Therefore, it is desired that the ink supply paths 11 be formed with relatively higher accuracy, and it often takes a relatively longer period of time for forming the ink supply paths 11.

Meanwhile, the removal of the single crystal silicon wafer in order to form the supply path formation region 14 of the substrate 13 thin has a small effect on ink, and hence, does not require high accuracy. That is, the supply path formation region 14 of the substrate 13 can be formed thin in a period of time shorter than that for forming the ink supply paths 11.

Thus, by forming the supply path formation region 14 of the substrate 13 thin, the ink supply paths 11 can be formed in a period of time shorter than that in a case of forming the ink supply paths 11 without forming the supply path formation region 14 thin.

Figure 4F:
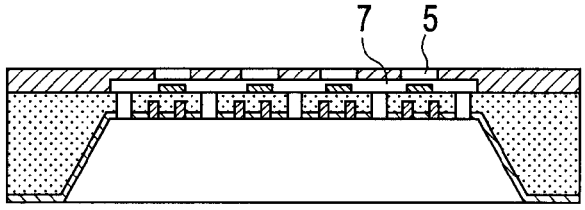

Subsequently, as illustrated in FIG. 4F, the mold (FIG. 4A) is removed to form the ink flow path 7 and the nozzles 5. The ink jet recording head 1 is completed by being separated into each chip shape from the single crystal silicon wafer with a dicer, if required.

Third Embodiment

Figure 5A:
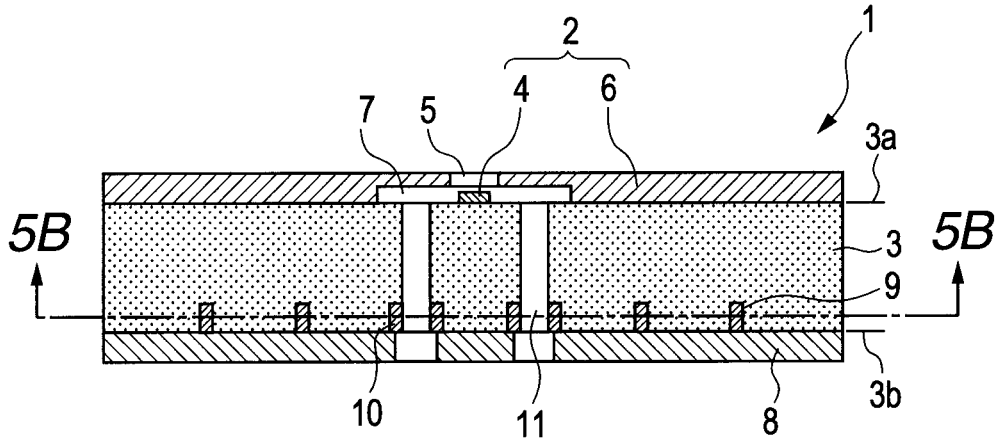
FIGS. 5A and 5B are cross-sectional views of an ink jet recording head according to a third embodiment of the present invention.
Figure 5B:
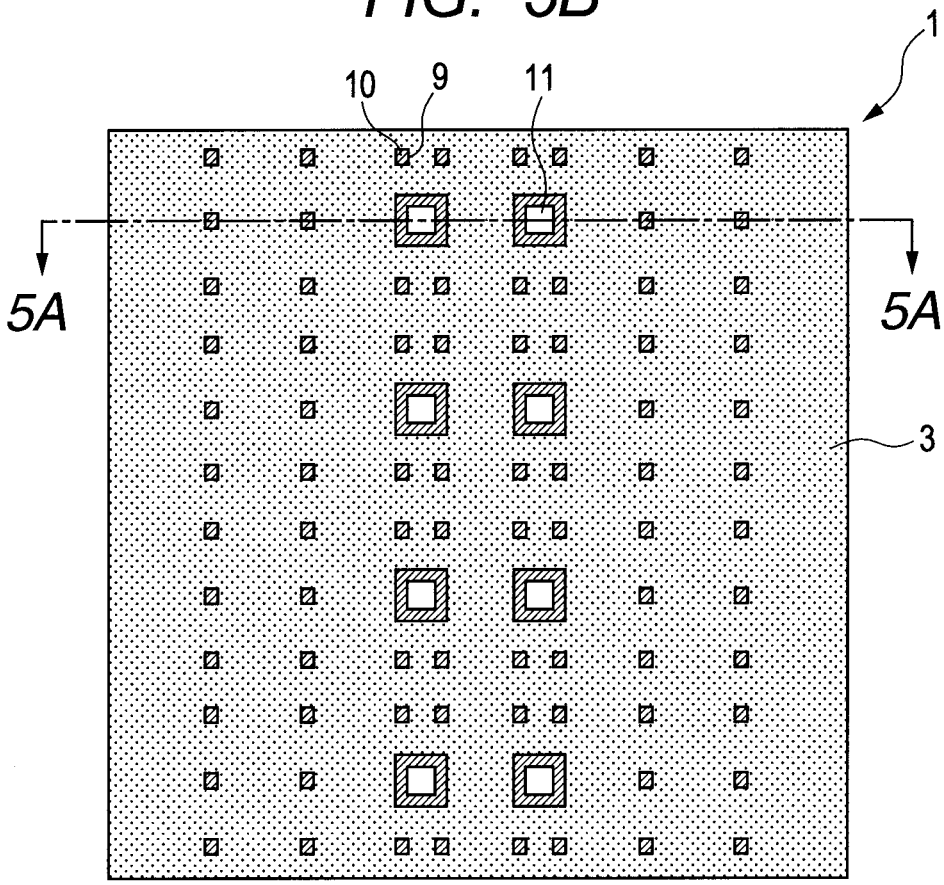

Next, an ink jet recording head according to a third embodiment of the present invention is described with reference to FIGS. 5A and 5B. FIGS. 5A and 5B are cross-sectional views of the ink jet recording head according to this embodiment. Description of the same components as those of the first embodiment is omitted.

As illustrated in FIG. 5A, the ink jet recording head 1 includes the ink ejection portion 2, the substrate 3, and the heat radiation member 8. Further, in the ink jet recording head 1, the ink supply paths 11 passing through the substrate 3 are formed so as to be surrounded by the heat radiation member 8 and the protrusions 10.

FIG. 5A is a cross-sectional view taken along line 5A-5A in FIG. 5B perpendicularly crossing the first surface 3*a* of the substrate 3 on which the ink ejection portion 2 is provided. FIG. 5B is a cross-sectional view taken along line 5B-5B in FIG. 5A parallel to the first surface 3*a* of the substrate 3.

As illustrated in FIGS. 5A and 5B, in the ink jet recording head 1 of this embodiment, the ink supply paths 11 are formed so as to be surrounded by the protrusions 10. By forming the ink supply paths 11 in this manner, the proportion of the path of each of the ink supply paths 11 surrounded by the heat radiation member 8 with respect to the total path of each of the ink supply paths 11 is increased.

A single crystal silicon wafer is often used for the substrate 3, and a metal such as Au is often used for the heat radiation member 8. A metal such as Au is removed sufficiently slowly in dry etching compared with the single crystal silicon wafer. Therefore, when the heat radiation member 8 and the protrusions 10 are formed of a metal such as Au, the substrate 3 can be processed by dry etching, using the heat radiation member 8 and the protrusions 10 as an etching mask. Thus, compared with the case of processing the substrate 3 by dry etching using only the heat radiation member 8 as the etching mask, the dimension stability of the ink supply paths 11 is enhanced.

Further, in a case of dry etching using ions, the heat radiation member 8 and the protrusions 10 block ions that do not enter in parallel to a direction along the path of the ink supply paths 11 with the use of the radiation member 8 and the protrusions 10 as the etching mask. Therefore, the ink supply paths 11 can be formed with high accuracy. At this time, as openings of the ink supply paths 11 are narrower, the heat radiation member 8 and the protrusions 10 block the ions more effectively, and hence the ink supply paths 11 can be formed with higher accuracy.

Accordingly, by increasing the proportion of the path of each of the ink supply paths 11 surrounded by the heat radiation member 8 and the protrusions 10, the ink jet recording head 1 including the ink supply paths 11 formed with higher accuracy can be obtained. As a result, ink can be stably supplied to the ink ejection portion 2, and an image with higher quality can be recorded at a higher speed.

REFERENCE SIGNS LIST

1 ink jet recording head
2 ink ejection portion
3 substrate
8 heat radiation member
9 recess
10 protrusion
11 ink supply path According to the present invention, the ink jet recording head having a higher heat radiation property, and the method of producing the ink jet recording head can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-020785, filed Feb. 2, 2011, which is hereby incorporated by reference herein in its entirety.

What is claimed is:

1. An ink jet recording head, comprising:

an ink ejection portion, in which heat is applied to ink supplied inside thereof, thereby providing the ink with a pressure for ejecting the ink outside;

a substrate having a first surface on which the ink ejection portion is provided and a second surface on an opposite side to the first surface, the second surface having at least one recess; and a heat radiation member for releasing heat outside, the heat being transmitted from the ink ejection portion to the substrate, the heat radiation member having a protrusion with a shape corresponding to a shape of the at least one recess, the protrusion being embedded in the at least one recess so that the protrusion is provided in direct contact with the at least one recess.

2. The ink jet recording head according to claim 1, further comprising an ink supply path for supplying ink from an outside thereof, the ink supply path being formed of a through-hole passing through the substrate and the heat radiation member.

3. The ink jet recording head according to claim 2, wherein:

the substrate includes a supply path formation region in which the ink supply path is formed and a supply path non-formation region other than the supply path formation region, the supply path formation region having a dimension in a direction along the ink supply path smaller than a dimension of the supply path non-formation region in the direction; and the at least one recess is formed at least in the second surface in the supply path formation region.

4. The ink jet recording head according to claim 2, wherein the heat radiation member has a material by which the through-hole is formable with a higher accuracy compared with a case of the substrate, and the ink supply path is formed so as to be surrounded by the protrusion of the heat radiation member.

5. The ink jet recording head according to claim 1, wherein the heat radiation member comprises any one metal of Au, Ta, Pt and Ir, or an alloy made of at least two of Au, Ta, Pt and Ir.

6. A method of producing an ink jet recording head including an ink ejection portion, in which heat is applied to ink supplied inside thereof, thereby providing the ink with a pressure for ejecting the ink outside; a substrate having a first surface on which the ink ejection portion is provided and a second surface on an opposite side to the first surface, the second surface having at least one recess; and a heat radiation member for releasing heat outside, the heat being transmitted from the ink ejection portion to the substrate, the heat radiation member having a protrusion with a shape corresponding to a shape of the at least one recess, the protrusion being embedded in the at least one recess so that the protrusion is provided in direct contact with the at least one recess, the method comprising:

a step of forming the at least one recess in the second surface of the substrate; and a step of forming the heat radiation member so that the heat radiation member covers the second surface under a state in which a material for the heat radiation member fills the at least one recess.

7. The method of producing an ink jet recording head according to claim 6, the ink jet recording head further including an ink supply path for supplying ink from an outside thereof to the ink ejection portion, the ink supply path being formed of a through-hole passing through the substrate and the heat radiation member, the method further comprising:

a step of removing a part of the heat radiation member formed in the heat radiation member forming step, corresponding to the ink supply path, to expose the second surface; and a step of removing the substrate in a part corresponding to the ink supply path from the exposed second surface by etching, with a remaining part of the heat radiation member being used as an etching mask, to form the ink supply path.

8. The method of producing an ink jet recording head according to claim 7, the inkjet recording being configured so that the substrate includes a supply path formation region in which the ink supply path is formed and a supply path non-formation region other than the supply path formation region, the supply path formation region having a dimension in a direction along the ink supply path smaller than a dimension of the supply path non-formation region in the direction; and the recess is formed at least in the second surface in the supply path formation region, the method further comprising a step of partially removing the supply path formation region of the substrate prior to the recess forming step, thereby making the supply path formation region thinner than the supply path non-formation region, wherein the recess forming step comprises forming the recess at least in the second surface in the supply path formation region.

* * * * *